United States Patent [19]

Marra et al.

[11] 4,128,955

[45] Dec. 12, 1978

[54] EXHIBITING DEVICE

[75] Inventors: Michael R. Marra; Joseph Del Deo, both of Warwick, R.I.

[73] Assignee: Cowan Plastic Products Corporation, Providence, R.I.

[21] Appl. No.: 790,074

[22] Filed: Apr. 22, 1977

[51] Int. Cl.[2] ..... G09F 11/00

[52] U.S. Cl. ..... 40/489; 40/618; 40/10 R

[58] Field of Search ..... 40/140, 142, 10 R, 373, 40/489

[56] References Cited

U.S. PATENT DOCUMENTS 2,510,331 6/1950 Crosby ..... 40/140

3,216,136 11/1965 Lang ..... 40/10 R

FOREIGN PATENT DOCUMENTS 1416768 11/1964 France ..... 40/140

*Primary Examiner*—Louis G. Mancene
*Assistant Examiner*—Wenceslao J. Contreras
*Attorney, Agent, or Firm*—Barlow & Barlow

[57] ABSTRACT

An exhibiting device formed from a one-piece plastic frame member recessed to receive a separate interchangeable insert member to be locked in the frame by suitable flexing of the insert member. Exhibiting may be had of small articles of jewelry, prices or other indicia on the insert member.

3 Claims, 6 Drawing Figures

EXHIBITING DEVICE

BACKGROUND OF THE INVENTION

Jewelry, for example, has been displayed upon "cards" usually formed from thin sheet or cardboard stock which are thrown away when they become soiled or a different article is to be mounted thereon. Likewise, such cards may carry price marks or other information pertinent to the sale of the article which is displayed thereon. In the prior art there is disclosed metal supports with insert letters which may be snapped in place with articles of jewelry such as in U.S. Pat. No. 1,921,437 where recesses are provided in the article to be snapped in, while projections are provided on the frame to receive the same or vice versa. A similar situation exists in U.S. Pat. No. 3,387,397 both primarily of metal structure. Tongues are sometimes provided to fit into recesses in tablet directories or the like such as in U.S. Pat. No. 1,514,517.

SUMMARY OF THE INVENTION

In this invention there is a one-piece molded plastic frame which has a recess to receive an insert member to be locked in place therein. The locking in place occurs by means of tongues on the insert member which are received in openings through the walls forming the recess, which openings have lips behind which the tongues extend to hold them in place. An opening is provided in the back of the recess so that the insert member may be manually engaged to be forced from its seated position in the frame. A hook-like protuberance extends from the rear of the frame enabling the frame to be hung on a wire or line support or to be tilted up slightly for better display when resting upon a horizontal surface.

DESCRIPTION OF THE PREFERRED EMBODIMENT

Figure 6:
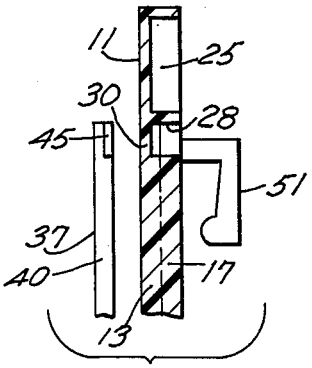
FIG. 6 is a fragmental sectional view illustrating the frame member and insert member as separated from one another.

The frame member is generally designated 10 and is formed from a single piece of plastic material molded into the shape to be utilized. This frame member has a top portion 11 and bottom portion 12 with sides 13 joining the top and bottom portions. The front surface of the top, bottom and side portions designated 14 is in a single plane as can perhaps best be seen in FIG. 2. A recess is formed in this front surface spaced inwardly from top, bottom and sides as seen in FIG. 3 and provides a seat for an insert member by portions of depressed marginal walls consisting of a top portion 15, a bottom portion 16 and side portions 17. These bottom wall portions are spaced slightly below the flat plane surface of the front 14 and provided edges at the top 20, bottom 21 and sides 22 for the guiding and positioning of an insert member to be described. The portions of the frame in which the recess is provided are thicker as might be seen in FIGS. 2 and 6 than the rearward recess upper portions 25 or 26 at the bottom or the insert member receiving recess above described.

Openings are provided in the bottom wall portion at the thicker portions as above defined at the juncture of the recess bottom wall with the guiding edges of the recess. Two of such openings 28 are located at the upper corners of the rectangular recess shown in FIG. 3 which extend completely through the bottom wall while lip portions such as 30 shown in the sectional view of FIGS. 3 and 6 extend outwardly therefrom. There is also an opening 34 in the mid portion of the lower strip of bottom wall portion 16 which passes completely through the bottom wall portion 16 and lip means 35 along the lower edge is provided by the bottom portion 12 of the frame as seen in FIG. 2.

An insert member 37 is shown in FIG. 3 as of rectangular shape corresponding to the shape of the frame recess having a top edge 38, bottom edge 39 which will engage and mate with the top edge 20 of the bottom wall portion 15 and bottom edge 21 of the bottom wall portion 16, while the side portions 40 will engage and mate with the edges 22 of the side bottom portion 17, the rectangular sides of the insert member 37 being easily moved into the recess portion in the frame to receive it and rest against the bottom wall portions 15, 16, 17 above described.

Figure 1:
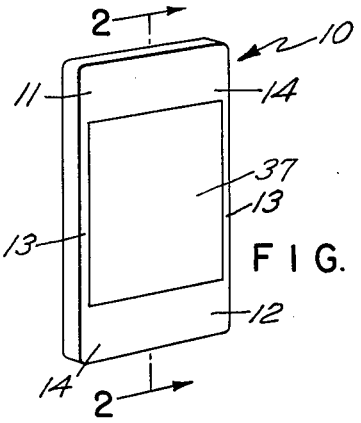
FIG. 1 is a perspective view of the exhibiting device frame member with the insert member located therein.
Figure 2:
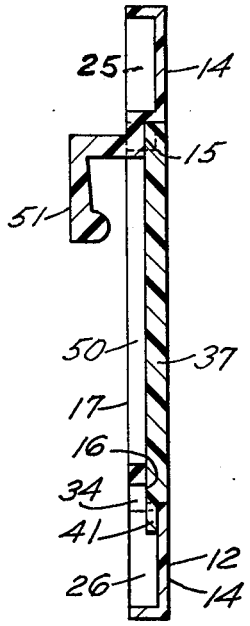
FIG. 2 is a central vertical sectional view of FIG. 1 on a larger scale better illustrating the hook on the back of the frame member for supporting it in position and also illustrating the interlocking of the tongues on the insert member and the openings in the frame member for holding the two assembled.
Figure 3:
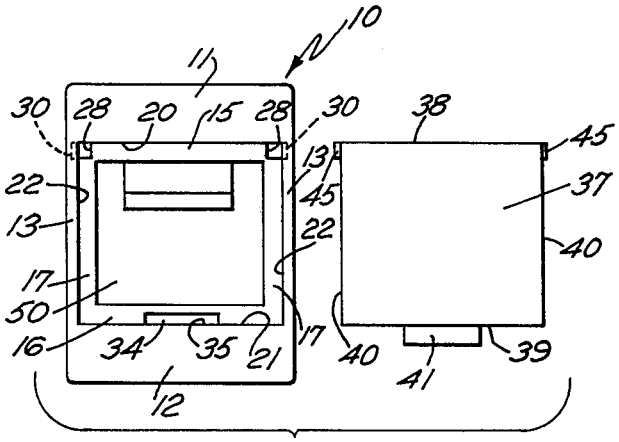
FIG. 3 is a front plan view of the frame member and the insert member separate from one another.
Figure 4:
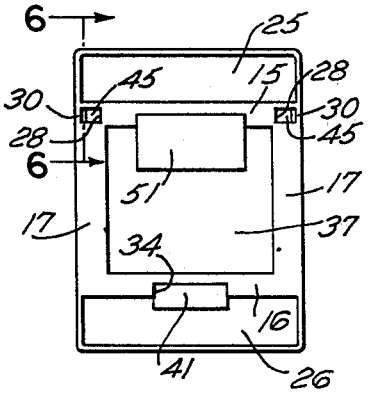
FIG. 4 is a rear view of the frame member and insert member in assembled relation.
Figure 5:
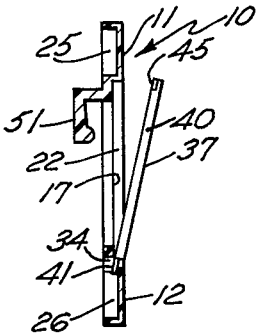
FIG. 5 is an edge elevation showing the manner of positioning the insert member in the frame member.

A tongue 41 of a thinner dimension than the thickness of the insert member 40 extends from the lower edge 39 of the insert member as is best shown in FIG. 2 and is such that it will pass through the opening 34 in the bottom wall portion 16 and lap over the bottom portion 12 of the frame member (FIG. 2). At the upper edge of the insert member there are additional tongues 45 extending laterally from the edges 40 of the insert member each of which is thinner than the insert member 37 and may pass through an opening 28 and extend under the lip portion 30 adjacent the opening first one side and then by flexing the other side to hold the member in place, this being permitted by the flexing of the insert member 37 as this occurs.

The back portion of the frame is left open as at 50 (FIGS. 2 and 3) so that the thumb or finger may engage the insert member 37 at the back portion thereof and snap it out of position when a fresh or different insert of different jewelry mounting, color or indicia thereon may be inserted.

A hook 51 is molded on the rear surface of the frame as can well be seen in FIG. 2 so that the frame may be hooked upon a line or wire support or if resting upon a horizontal surface, the hook will support the entire frame and its insert member at a slightly inclined position for better view.

We claim:

1. An exhibiting device comprising a one-piece frame member having a front surface with a recess of an enclosed geometric figure depressed therefrom providing edges thereabout and a portion of a bottom wall extending along said edges completely about said figure leaving a mid portion open, an insert member of a size and shape to fit said recess and enter said recess from said front surface by engaging an edge thereof and then swinging into position about said edge as a pivotal axis without projecting through said bottom wall and engage said portion of said bottom wall with its edges engaging the edges of said recess for locating its position, a tongue on said insert member along one of its edges and an opening in said bottom wall along the engaged edge of said recess to receive said tongue, a pair of tongues at spaced locations along opposite edges of said insert member and openings in said bottom wall along the edge of said recess at the location of said tongues to receive said tongues, said openings being at the juncture of said recess edges and bottom wall and means to provide a lip along each of said openings by a reduction of the thickness of stock along the portion bordering said recess and each of said tongues after passing through an opening engaging a lip to hold the insert member in place against said bottom wall.

2. An exhibiting device as in claim 1 wherein said insert member is flexible and of a size to be flexed in the positioning of said tongues in said openings.

3. An exhibiting device as in claim 1 wherein said open mid portion provides a center hole through the frame for the engagement of said insert member from the back of the frame member to flex the insert member to remove it from the frame.

* * * * *